US009532622B2

(12) United States Patent
Gillett

(10) Patent No.: US 9,532,622 B2
(45) Date of Patent: Jan. 3, 2017

(54) FOOTWEAR

(71) Applicant: Lisa Jill Gazzard, Burleigh Heads (AU)

(72) Inventor: Matthew Gillett, Currumbin (AU)

(73) Assignee: Lisa Jill Gazzard, Burleigh Heads (AU)

( * ) Notice: Subject to any disclaimer, the term of this patent is extended or adjusted under 35 U.S.C. 154(b) by 460 days.

(21) Appl. No.: 13/769,449

(22) Filed: Feb. 18, 2013

(65) Prior Publication Data

US 2013/0152427 A1 Jun. 20, 2013

Related U.S. Application Data

(63) Continuation-in-part of application No. 12/598,115, filed on Nov. 6, 2009, now abandoned.

(30) Foreign Application Priority Data

Apr. 30, 2007 (AU) ..... 2007902233
Jun. 30, 2007 (AU) ..... 2007903313
Apr. 29, 2008 (AU) ..... PCT/AU2008/000589

(51) Int. Cl.

| | |
|---|---|
| ***A43B 3/12*** | (2006.01) |
| ***A43B 13/12*** | (2006.01) |
| ***A43B 3/24*** | (2006.01) |
| ***A43B 1/00*** | (2006.01) |

(52) U.S. Cl.

CPC ..... *A43B 3/242* (2013.01); *A43B 1/0081* (2013.01); *A43B 3/244* (2013.01)

(58) Field of Classification Search

CPC ..... A43B 3/242; A43B 3/244; A43B 3/248; A43B 1/0081; A43B 23/0295

USPC ..... 36/101, 100, 102, 103

See application file for complete search history.

(56) References Cited

U.S. PATENT DOCUMENTS

| | | | | |
|---|---|---|---|---|
| 2,236,367 | A | | 3/1941 | Gruber |
| 2,493,154 | A | * | 1/1950 | Mavrakis ..... 36/101 |
| 2,507,120 | A | | 5/1950 | Shapiro |
| 4,267,650 | A | | 5/1981 | Bauer |
| 4,887,369 | A | | 12/1989 | Bailey et al. |

(Continued)

FOREIGN PATENT DOCUMENTS

| | | |
|---|---|---|
| CN | 2207099 | 9/1995 |
| DE | 3536959 | 4/1987 |

(Continued)

*Primary Examiner* — Jila M Mohandesi

(74) *Attorney, Agent, or Firm* — Stephen T. Scherrer; Monique A. Morneault; Scherrer Patent & Trademark Law, P.C.

(57) ABSTRACT

A pair of footwear items including a left footwear item and a right footwear item, each of the footwear items comprising a sole portion and an upper portion, the upper portion and the sole portion adapted for at least temporary connection to one another, the upper portion consisting of a support element having at least a first surface and a second surface and wherein each of the first surfaces includes an upper of a first style of footwear, and each of the second surfaces includes an upper of a second style of footwear, and wherein the pair of footwear items is converted between the first and second styles of footwear by removing and inverting the upper portions and connecting the upper portion removed from the left footwear item to the right footwear item and connecting the upper portion removed from the right footwear item to the left footwear item.

8 Claims, 12 Drawing Sheets

(56) References Cited

U.S. PATENT DOCUMENTS

| | | | | |
|---|---|---|---|---|
| 5,822,888 | A | 10/1998 | Terry | |
| 6,035,554 | A | 3/2000 | Duncan | |
| 6,427,363 | B1 | 8/2002 | Hunter | |
| 6,442,869 | B2 | 9/2002 | Coomes | |
| 7,117,615 | B2 * | 10/2006 | Gerber | 36/101 |
| 7,222,442 | B2 | 5/2007 | Hillyer | |
| 7,797,857 | B2 | 9/2010 | Mattia | |
| 8,151,491 | B2 | 4/2012 | Sarantakos | |
| 8,307,570 | B2 | 11/2012 | Delgatty | |
| 2003/0046829 | A1 | 3/2003 | Baechtold | |
| 2005/0262738 | A1 * | 12/2005 | Gerber | 36/101 |
| 2006/0075656 | A1 | 4/2006 | Januszewski et al. | |
| 2006/0090374 | A1 | 5/2006 | Hillyer et al. | |
| 2006/0248753 | A1 | 11/2006 | Welsh | |

FOREIGN PATENT DOCUMENTS

| | | | |
|---|---|---|---|
| DE | 20 2004 005 940 | U1 | 7/2004 |
| DE | 20 2004 016 153 | U1 | 4/2005 |
| FR | 2246163 | | 4/1975 |
| GB | 2443382 | | 5/2008 |
| WO | 2005/009161 | A1 | 2/2005 |
| WO | 2007118262 | | 10/2007 |

* cited by examiner

FOOTWEAR

CROSS-REFERENCE TO RELATED APPLICATIONS

This application is a continuation-in-part of U.S. patent application Ser. No. 12/598,115 filed on Nov. 6, 2009, which was the National Stage of International Application No. PCT/AU2008/000589, filed Apr. 29, 2008, which claims priority to Australia Patent Application No. 2007902233 filed Apr. 30, 2007, and Australia Patent Application No. 2007903313 filed Jun. 30, 2007.

FIELD OF THE INVENTION

The present invention relates to footwear. In particular, the present invention relates to footwear which may be readily converted between several different styles of footwear.

BACKGROUND ART

There are many situations in which a particular style of footwear may not be suitable for use in another situation. For instance, while thongs (alternatively referred to as flip-flops) may be of great benefit for keeping a wearer's feet cool during hot weather, a sudden or unexpected change in weather conditions may result in the wearer getting cold feet. In addition, while footwear such as thongs may be considered acceptable at the beach or in other casual surroundings, some restaurants, bars, nightclubs and the like may not allow entry to patrons who do not comply with certain dress codes, such as wearing closed-in shoes.

In order to avoid these situations, it would be necessary to carry a spare pair of shoes. However, this is generally not a practical solution. In addition, there are times when a person may not expect that they will require a change of footwear, and will therefore be caught unawares if any sudden change of activities occurs.

Therefore, there would be an advantage if it were possible to provide a type of footwear that could be easily and simply converted between more casual and more formal forms of footwear in order to allow the wearer to fit in to a variety of situations without needing to change their footwear.

It will be clearly understood that, if a prior art publication is referred to herein, this reference does not constitute an admission that the publication forms part of the common general knowledge in the art in Australia or in any other country.

Throughout this specification, the term "comprising" and its grammatical equivalents shall be taken to have an inclusive meaning unless the context of use indicates otherwise.

OBJECT OF THE INVENTION

It is an object of the present invention to provide footwear which may overcome at least some of the abovementioned disadvantages, or provide a useful or commercial choice.

In a first aspect of the invention there is provided a footwear item comprising a sole, retention means adapted to assist in retaining the footwear item on a foot, and conversion means adapted to allow conversion of the footwear item between two or more styles of footwear.

In this manner, the footwear item can be readily converted between styles of footwear as a particular situation dictates without the need for changing pairs of footwear.

The sole may be of any suitable form and constructed from any suitable material, such as, but not limited to, rubber, plastic, leather or any combination thereof. The sole may have a lower surface which, in use, may be in contact with the ground, and an upper surface which, in use, may be in contact with the user's foot.

The form of the retention means is not critical. However, the retention means may suitably comprise any means for assisting in retaining the footwear item on a foot, such as, but not limited to, one or more laces, buckles, ties, adhesives or any combination thereof. In some preferred embodiments of the invention, however, the retention means comprises at least one strap. The at least one strap may be of any suitable form, although in some embodiments of the present invention, a single strap may pass over the toes or front portion of the wearer's foot. The strap may be adapted to connect to any suitable point on the sole of the footwear item, such as the upper surface of the sole or a side of the sole. The strap may be of any suitable shape, and may be constructed from any suitable material, for instance rubber, plastic, leather, cloth or webbing.

In a preferred embodiment of the invention, the at least one strap may further comprise at least one post. The at least one post may be located such that, when in use, the at least one post is held between two of the wearer's toes. The at least one post may be connected to the strap at one end and, in a preferred embodiment of the invention, may be connected to the upper surface of the sole at the opposed end.

The conversion means may comprise any suitable form. However, in a preferred embodiment of the invention, the conversion means comprises one or more panels that may be moved between a retracted position and an extended position in order to convert the footwear item from one style of footwear to another. Preferably, the one or more panels may be formed from a flexible material.

In the retracted position, the one or more panels may be folded, tucked, rolled or otherwise stored so that they do not form an active part of the footwear item. The one or more panels may be stored in any suitable location, such as wrapped around the retention means, laying flat on the upper surface of the sole under the wearer's foot or folded down the sides of the sole. Preferably, the one or more panels are retained in the retracted position on the footwear item using suitable attachment means. The attachment means may comprise any suitable form, such as, but not limited to, one or more press-studs, hook and loop (Velcro) patches or strips, hooks, catches, straps, zips, buckles, buttons, ties or the like or any combination thereof.

To move the one or more panels from the retracted position to the extended position, the attachment means may be released, and the one or more panels may be moved into position. The one or more panels may be retained in position by any suitable means. However, in some preferred embodiments of the invention, the same type of attachment means to those used to retain the one or more panels in the retracted position may also be used to retain the one or more panels in the extended position.

Any suitable arrangement and number of panels may be used. However, in some embodiments of the invention, there may be provided one panel for each side of the footwear item, one or more panels for the front of the footwear item and one panel for the heel of the footwear item. The panels may all function independently of one another, meaning that any combination of panels may be moved to the extended position without the need for all of the panels to be extended at the same time.

The panels may be constructed from any suitable material, such as, but not limited to, leather, fabric, webbing, canvas, rubber, plastic or any combination thereof.

By moving a combination of panels to the extended position it may be possible to convert the footwear item into a large number of different styles of footwear. For instance, when all panels are in the retracted position, the footwear item may be in the form of a thong or sandal. When only the panels at the front of the footwear item are in the extended position, the footwear item may be in the form of a slipper. Alternatively, when all the panels are in the extended position, the footwear item may be in the form of a closed-in shoe.

In another aspect, the invention resides broadly in a pair of footwear items including a left footwear item and a right footwear item, each of the footwear items comprising a sole portion and an upper portion, the upper portion and the sole portion adapted for at least temporary connection to one another, the upper portion consisting of a support element having at least a first surface and a second surface and wherein each of said first surfaces includes an upper of a first style of footwear, and each of said second surfaces includes an upper of a second style of footwear, and wherein the pair of footwear items is converted between the first and second styles of footwear by removing the upper portions from the left footwear item and the right footwear, inverting the upper portions, and connecting the upper portion removed from the left footwear item to the right footwear item and connecting the upper portion removed from the right footwear item to the left footwear item.

The upper may be for any suitable style of footwear. For instance, the upper may be for a thong, slide, scuff, slipper, sandal, closed-in shoe (such as a lace-up shoe, slip-on shoe, deck shoe etc.) or the like.

The sole portion may be of any suitable form. However, it is preferred that the sole portion comprises a lower surface and an upper surface. In use, the lower surface may be adapted to be in contact with the ground. In some embodiments of the invention, the lower surface of the sole portion may be provided with a tread, spikes, cleats or the like for improving the wearer's grip on the ground.

The upper surface of the sole portion may comprise connection means for connecting the upper portion of the footwear item. Any suitable connection means may be provided, such as, but not limited to, one or more press-studs, hook and loop (Velcro) patches or strips, hooks, catches, straps, zips, buckles, buttons, ties or the like or any combination thereof. A skilled addressee will understand that the connection means may be located at any suitable point on the upper surface of the sole, including at or adjacent an outer periphery of the upper surface. In some embodiments of the invention, the connection means may be provided on an outer edge of the sole portion.

Alternatively, the upper surface of the sole portion may be provided with one or more connection members in the form of, for example, seals (such as rubber or plastic seals) adapted to connect to and retain at least a portion of the upper portion during use. Preferably, the one or more connection members extend at least partially along the outer periphery of the sole portion.

In one embodiment of the invention, the one or more connection members may only extend partway around the periphery of the sole portion, so that one or more gaps in the connection members are provided around the periphery of the sole portion. The one or more gaps may be of any suitable length and located at any suitable location on the periphery of the sole portion. The one or more gaps may be provided so as to allow a user to more easily access the upper portion so as to remove it from the sole portion. For instance, a user may be able to insert one or more fingers or a tool through the gap so as to facilitate the removal of the upper portion from the sole portion.

The connection members may comprise a single connection member that extends partway around the periphery of the sole portion. In this embodiment, it is envisaged that the single connection member may comprise an elongate member having a first end and a second end that are spaced apart from one another around the periphery of the sole portion so as to form a gap therebetween. Alternatively, a plurality of discrete connection members may be provided around the periphery of the sole portion, the plurality of connection members by spaced apart from one another so that gaps are formed therebetween. The size of the gaps is not crucial, and may vary as required, as may the length of the plurality of connection members. In embodiments of the invention in which multiple connection members are provided, the gaps between the connection members may be the same as, or different to, one another.

In some embodiments of the invention, the upper portion may be adapted for connection to two or more sole portions. Thus, the upper portion may be disconnected from a first sole portion and reconnected to a second sole portion. In this way, if the sole portion is, for instance, worn or damaged, the working life of the upper portion may be extended by connecting it to a new or undamaged sole portion.

Alternatively, different sole portions may be provided with different features. For instance, different sole portions may be provided with different tread patterns, sole thickness or the like. Thus, a user may be able to disconnect the upper portion from a first sole portion and connect the upper portion to a second sole portion having a tread pattern that provides the user with improved grip in wet weather. In another embodiment of the invention (for instance, wherein the footwear item is adapted to be used as ladies' footwear), a first sole portion may be provided with a flat heel, while a second sole portion may be provided with a high heel, thereby allowing the user to connect the same upper portion to two or more styles of sole portion.

As previously stated, when the footwear items are converted between styles of footwear, the upper portion removed from the left footwear item is inverted and connected to the right footwear item, while the upper portion from the right footwear item is inverted and connected to the left footwear item. Thus, it is envisaged that the upper portions may be mirror images of one another when uppers of a like style of footwear are oriented upwards.

For the sake of clarity, the invention may be envisaged as, for instance, a pair of footwear items in the form of closed-in shoes comprising a left shoe and a right shoe. If a user desires to convert the closed-in shoes to thongs, it is envisaged that the user would remove the left shoe upper portion from the left shoe sole portion of the left shoe, invert the left shoe upper portion so that a thong upper is now facing upwards, and then connect the left shoe upper portion to the right shoe sole portion. Similarly, the right shoe upper portion would be removed from the right shoe sole portion of the right shoe, then the right shoe upper portion would be inverted so that a thing upper is now facing upwards. The right shoe upper portion would then be connected to the left shoe sole portion.

It is envisaged that this procedure would be reversed when it is desired to convert the pair of footwear items from thongs to closed-in shoes.

In some embodiments of the invention, the upper portion may lock into place, for instance with an audible snap or click to inform the user to when the upper portion and the sole portion are fully connected.

In other embodiments of the invention, the footwear items may be provided with a release mechanism (for instance, one or more levers, buttons or the like, or a combination thereof) to allow the user to quickly and simply disconnect the upper portion and the sole portion.

In some embodiments of the invention, the connection means or connection members located on the upper surface of the sole portion connect with complimentary connection means or connection members located on the upper portion of the footwear item to ensure that the connection between the upper portion and the sole portion of the footwear item is sufficient to prevent the two portions of the footwear item from becoming disconnected during use. Alternatively, the connection means or connection members located on the sole portion of the footwear item may be adapted to connect the support element of the upper portion, thereby retaining the upper portion on the sole portion during use.

In some embodiments of the invention, at least a portion of the outer periphery of the sole portion may be provided at a different height to at least a portion the upper surface of the sole portion. In this way, the upper surface of the sole portion may be provided with one or more recesses. The one or more recesses may be used to house the upper provided on one surface of the support element when the footwear item is in use.

The support element of the upper portion of the footwear item may be of any suitable form, and formed from any suitable material. While the support element could conceivably be formed from a rigid material, it is envisaged that the support element may be formed from a material that is at least semi-flexible. Preferably, the first and second surfaces of the support element are provided on opposite sides of the support element and are separated from one another by the thickness of the support element.

In some embodiments of the invention, the first and second surfaces of the support element may be of sufficient size and configuration to accommodate a user's foot thereon. In particular, it is envisaged that the sole of the user's foot will, during use of the footwear item, be at least partially in contact with either the first or second surface.

The upper may be of any suitable form. For instance, the upper may be in the form of the upper portion of a boot, closed-in shoe (e.g. lace-up shoe, slip-on shoe or the like), slipper, thong, scuff, slide or the like.

In a preferred embodiment of the invention, both of the first and second surfaces of the support element are provided with uppers. In this embodiment of the invention, it is preferred that the upper provided on the first surface is different to that provided on the second surface of the support element.

In this embodiment of the invention, the upper portion of the footwear item may be connected to the sole portion such that the first surface of the support element is facing upwards. A user may disconnect the upper portion from the sole portion and turn or invert the upper portion such that the second surface of the support element is facing upwards while the first surface is facing downwards. Once in this position, the upper portion may be re-connected with the sole portion such that the user may now make use of the upper provided on the second surface of the support element.

In some embodiments of the invention, the upper may be provided with means for assisting in folding the upper prior to the upper being placed in the recess in the sole portion. The means may be of any suitable type, although it is envisaged that the means may consist of one or more press-studs, hook and loop (Velcro) patches or strips, hooks, catches, straps, zips, buckles, buttons, ties or the like or any combination thereof. The aim of these means is to ensure that the upper folds neatly and flatly for storage so that the user does not feel any bumps or lumps under their foot from the non-active upper.

While the upper may be constructed to be for a single type of footwear only, it is envisaged that the upper may be provided with conversion means to allow the upper to be converted between two or more types of footwear.

The conversion means may comprise any suitable form. However, in a preferred embodiment of the invention, the conversion means comprises one or more panels that may be moved between a retracted position and an extended position in order to convert the footwear item from one style of footwear to another. Preferably, the one or more panels may be formed from a flexible material.

In the retracted position, the one or more panels may be folded, tucked, rolled or otherwise stored so that they do not form an active part of the footwear item. The one or more panels may be stored in any suitable location, such as wrapped around the strap of a thong, lying flat on the surface of the support element under the wearer's foot or folded down the sides of the sole portion. Preferably, the one or more panels are retained in the retracted position using suitable attachment means. The attachment means may comprise any suitable form, such as, but not limited to, one or more press-studs, hook and loop (Velcro) patches or strips, hooks, catches, straps, zips, buckles, buttons, ties or the like or any combination thereof.

To move the one or more panels from the retracted position to the extended position, the attachment means may be released, and the one or more panels may be moved into position. The one or more panels may be trained in position by any suitable means. However, in some preferred embodiments of the invention, the same type of attachment means to those used to retain the one or more panels in the retracted position may also be used to retain the one or more panels in the extended position.

Any suitable arrangement and number of panels may be used. However, in some embodiments of the invention, there may be provided one panel for each side of the footwear item, one or more panels for the front of the footwear item and one panel for the heel of the footwear item. The panels may all function independently of one another, meaning that any combination of panels may be moved to the extended position without the need for all of the panels to be extended at the same time.

The panels may be constructed from any suitable material, such as, but not limited to, leather, fabric, webbing, canvas, rubber, plastic or any combination thereof.

By moving a combination of panels to the extended position it may be possible to convert the footwear item into a large number of different styles of footwear. For instance, when all panels are in the retracted position, the footwear item may be in the form of a thong or sandal. When only the panels at the front of the footwear item are in the extended position, the footwear item may be in the form of a slipper. Alternatively, when all the panels are in the extended position, the footwear item may be in the form of a closed-in shoe.

In another aspect, the invention resides broadly in a footwear item comprising a sole portion and an upper portion, the upper portion and the sole portion adapted for at least temporary connection to one another, the upper portion consisting of a support element having at least a first surface and a second surface and wherein the first surface includes an upper of a first style of footwear, and the second surface includes an upper of a second style of footwear, and wherein the sole portion is provided with one or more connection members extending partially along an outer periphery of the sole portion.

Preferably, the connection members may be formed by providing one or more gaps in the connection members so as to allow a user to gain access to the upper portion through the one or more gaps. Allowing the user to gain access to the upper portion through the one or more gaps may allow a user to more easily disconnect the upper portion from the sole portion.

Preferably, the footwear item is provided in a pair of footwear items, wherein a first of the pair of footwear items is a left footwear item and a second of the pair of footwear items is a right footwear item.

BRIEF DESCRIPTION OF THE DRAWINGS

An embodiment of the invention will be described with reference to the following drawings in which.

DETAILED DESCRIPTION OF THE INVENTION

Figure 1:
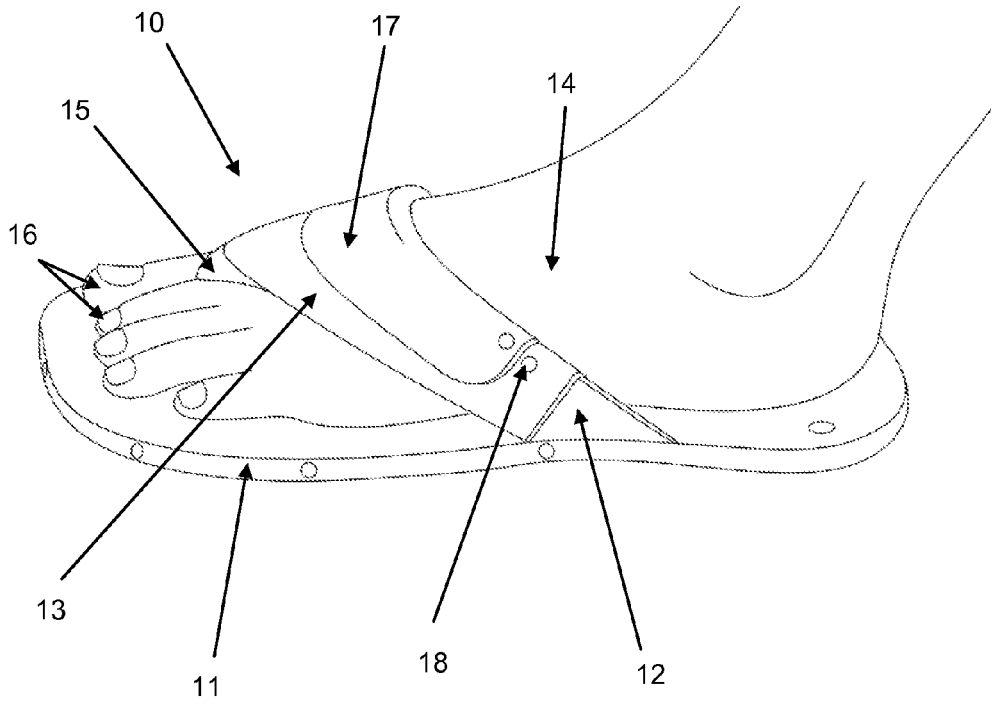
FIG. 1 illustrates a view of the footwear item according to an embodiment of the present invention when arranged in a first configuration.

It will be appreciated that the drawings have been provided for the purposes of illustrating preferred embodiments of the present invention and that the invention should not be considered to be limited solely to the features as shown in the drawings.

Referring to FIG. 1 of the drawings there is illustrated a footwear item 10 according to one embodiment of the present invention in which the footwear item 10 is in the form of a thong. The footwear item 10 comprises a sole 11 and retention means 12 in the form of a strap 13 passing over a front portion of the wearer's foot 14. The retention means 12 further comprises a post 15 interconnecting the strap 13 and the sole 11. When in use, the post 15 is located between the wearer's toes 16. This assists in ensuring that the footwear item 10 is retained on the foot 14 during use.

Conversion means in the form of panels 17 of fabric are wrapped around the strap 13 when the panels 17 are in the retracted position. In the embodiment of the invention illustrated in FIG. 1, the panels 17 are retained on the strap 13 in the retracted position by use of press-studs 18.

Figure 2:
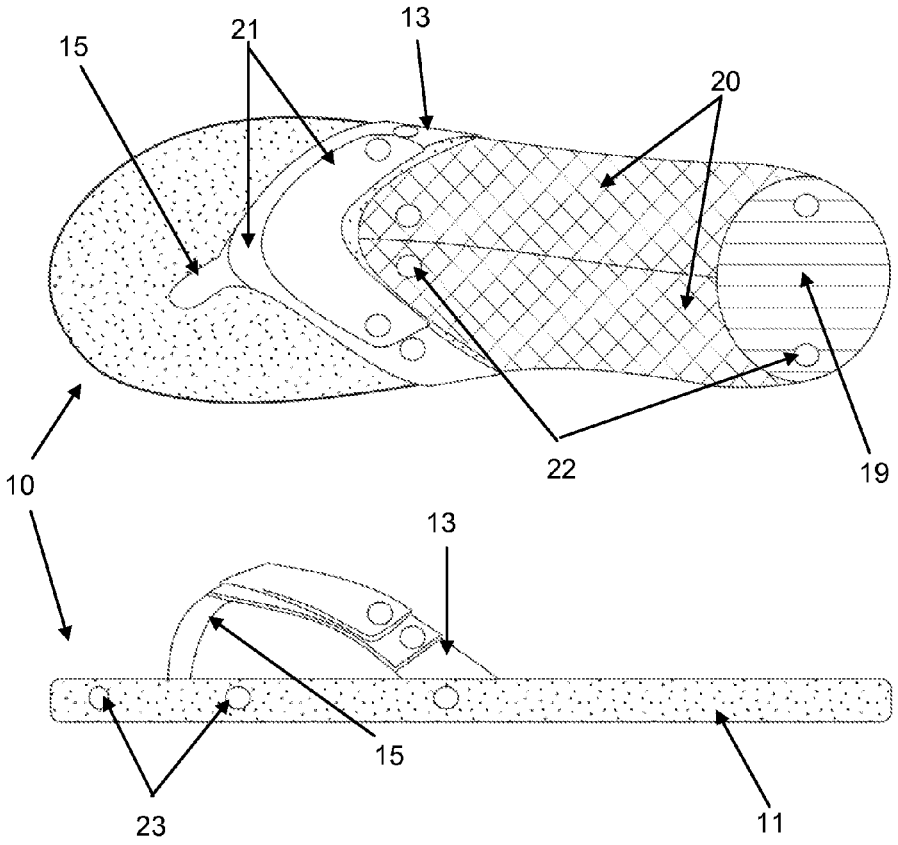
FIG. 2 illustrates a plan view of the footwear item according to an embodiment of the present invention which arranged in a first configuration.

Turning now to FIG. 2 there is shown an footwear item 10 according to one embodiment of the present invention. The footwear item 10 illustrated in FIG. 2 is in the form of a thong. The footwear item 10 comprises a sole 11 and retention means in the form of a strap 13, with a post 15 interconnecting the strap 13 and the sole 11.

The footwear item 10 illustrated in FIG. 2 comprises a heel panel 19, a pair of side panels 20 and a pair of front panels 21, all of which are in the retracted position. In this position the heel panel 19 and pair of side panels 20 lie flat on the sole 11 of the footwear item 10 and are retained in place by a plurality of press-studs 22. The front panels 21 are wrapped around the strap 13 in the retracted position.

The footwear item 10 comprises a further series of press-studs 23 located on the side of the sole 11 which are used to retain the front panels 21 in place when the front panels 21 are in the extended position.

Figure 3:
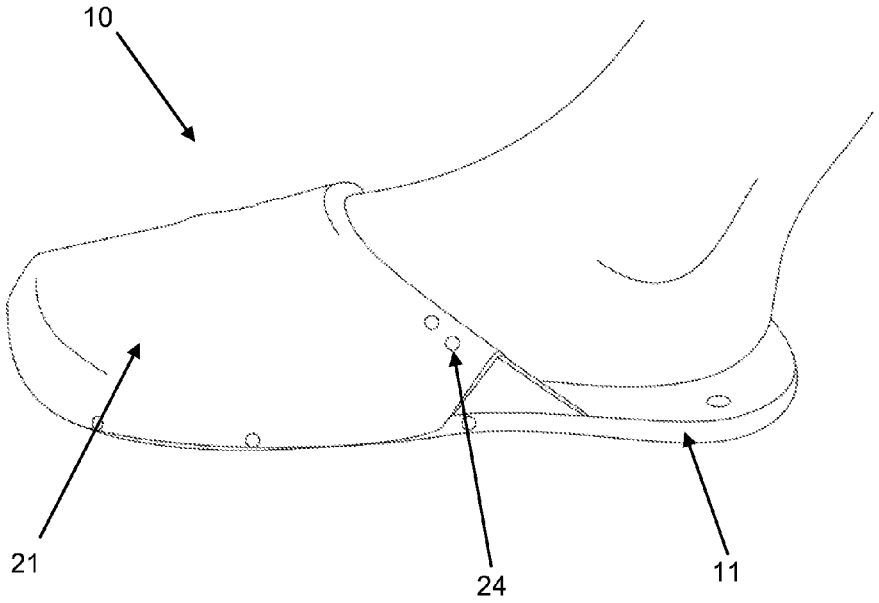
FIG. 3 illustrates a view of the footwear item according to an embodiment of the present invention when arranged in a second configuration.

In FIG. 3 there is illustrated in footwear item 10 according to an embodiment of the present invention in which the footwear item 10 is in the form of a slipper. In this form of the invention, the pair of front panels 21 have been disconnected from the strap (not shown) by disconnecting press-studs 24 that held the front panels 21 in place on the strap (not shown) in the retracted position. To retain the front panels 21 in the extended position illustrated in FIG. 3, the press-studs (not shown) on the front panels 21 are connected to a series of press-studs (not shown) located on the side of the sole 11.

Figure 4:
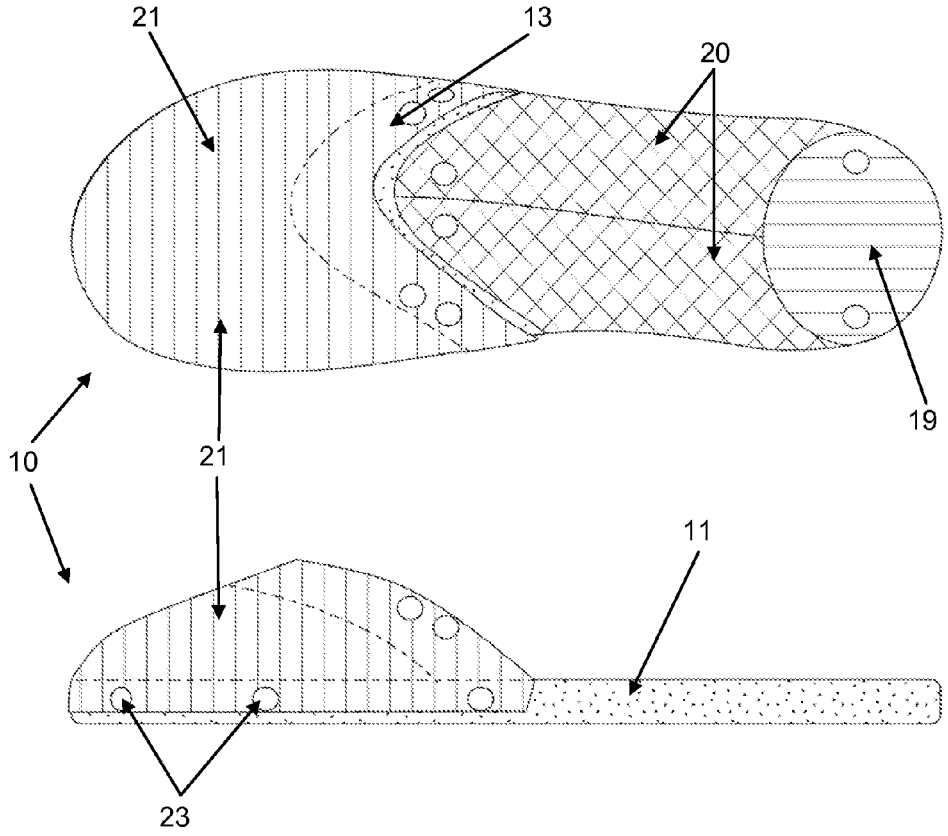
FIG. 4 illustrates a plan view of the footwear item according to an embodiment of the present invention when arranged in a second configuration.

In FIG. 4 there is illustrated in footwear item 10 according to an embodiment of the present invention in which the footwear item 10 is in the form of a slipper. In this Figure, the front panels 21 have been disconnected from the strap 13 and moved to the extended position. The press-studs (not shown) provided on the front panels 21 are connected to the series of press-studs 23 located on the side of the sole 11 in order to retain the front panels 21 in place in the extended position. When the footwear item 10 is in the form of a slipper as illustrated in FIG. 4, the heel panel 19 and the pair of side panels 20 are maintained in the retracted position lying flat against the upper surface of the sole 11.

Figure 5:
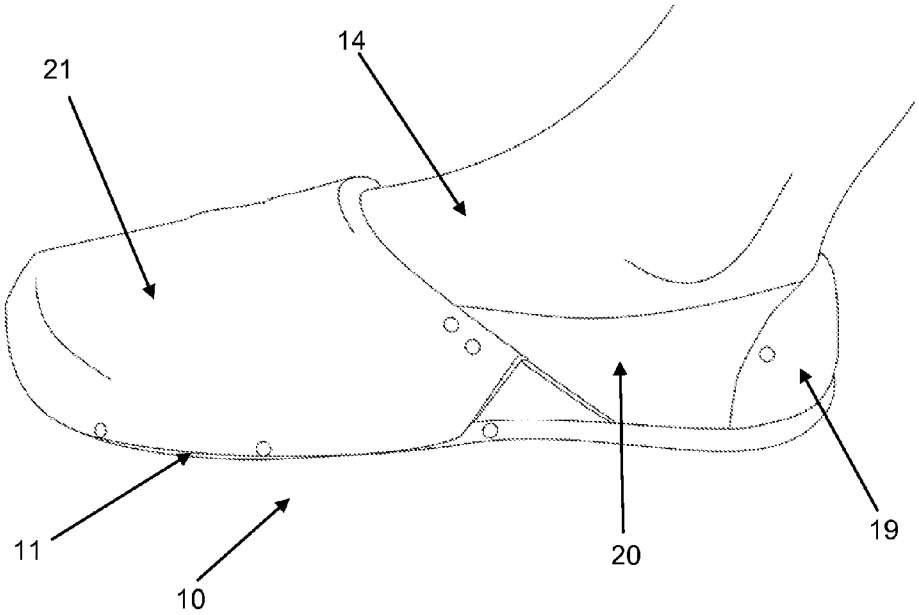
FIG. 5 illustrates a view of the footwear item according to an embodiment of the present invention when arranged in a third configuration.

In FIG. 5 there is illustrated an footwear item 10 according to one embodiment of the invention in which the footwear item 10 is in the form of a closed-in footwear item. In the embodiment of the invention illustrated, the front panels 21, side panels 20 and heel panel 19 have all been moved to the extended position to form an footwear item 10 that entirely encloses the wearer's foot 14.

The front panels 21 are retained in the extended position by connecting press-studs (not shown) provided on the front panels 21 with press-studs (not shown) located on the side of the sole 11. Similarly, the side panels 20 are retained in the extended position by connecting press-studs (not shown) located on the side panels 20 with press-studs (not shown) located either on the strap (not shown) or on the front panels 21. The heel panel 19 is retained in the extended position by connecting press-studs (not shown) provided on the heel panel 19 with press-studs (not shown) located on each of the side panels 20.

Figure 6:
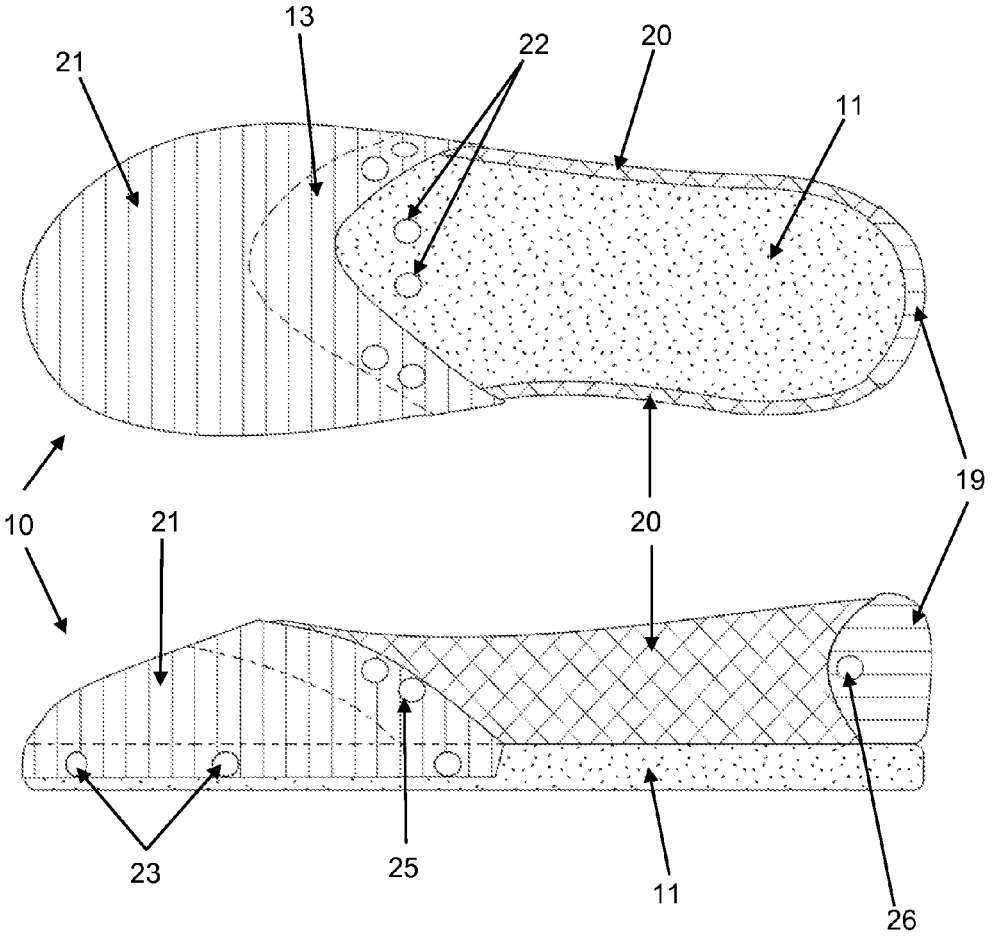
FIG. 6 illustrates a plan view of the footwear item according to an embodiment of the present invention when arranged in a third configuration.

Turning now to FIG. 6, there is shown a footwear item 10 according to an embodiment of the invention in which the footwear item 10 is in the form of a closed-in footwear item. In this embodiment of the invention the front panels 21, side panels 20 and heel panel 19 have all been moved from the retracted position to the extended position. As previously discussed, the front panels 21 have been disconnected from the strap 13 and have been brought into connection with a series of press-studs 23 located on the side of the sole 11 in order to retain the front panels 21 in place in the extended position. The side panels 20 have been disconnected from the press-studs 22 located on the upper surface of the sole 11. The side panels 20 and the front panels 21 are connected together using press-studs 25 and are retained in place during use.

Similarly, the heel panel 19 is connected to the side panels 20 using press-studs 26 to retain the heel panel 19 and side panels 20 in place during use.

Figure 7:
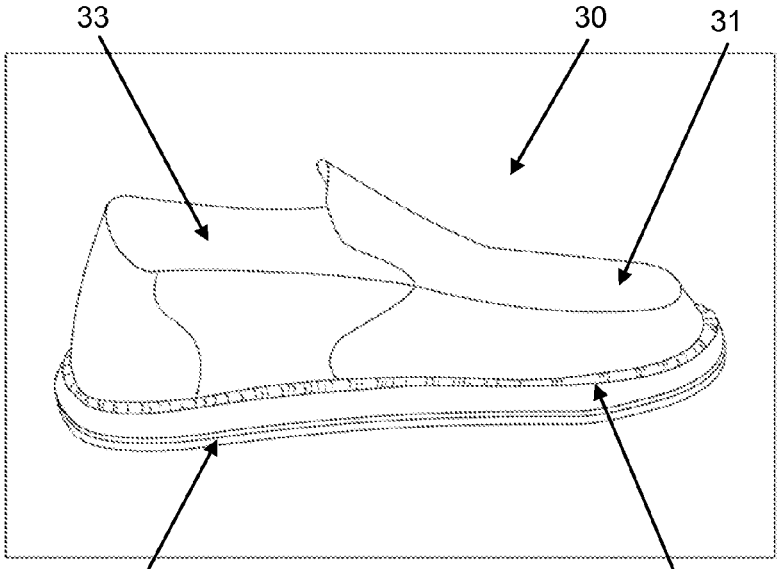
FIG. 7 illustrates a footwear item according to an embodiment of the present invention.

In FIG. 7, an alternative embodiment of the invention is shown. In this Figure, the footwear item 30 comprises an upper portion 31 and a sole portion 32. The upper portion 31 comprises a support element (obscured) which includes an upper 33 in the form of a closed-in shoe are associated. In this Figure, the sole portion 32 and the upper portion 31 are shown in connection with one another. The connection between the sole portion 32 and the upper portion 31 is a removable connection and is achieved by providing the sole portion 32 with a connection member 34 which extends along a length of the outer periphery of the sole portion 32. The connection member 34 is adapted to connect to the support element (obscured) of the upper portion 31, thereby retaining the upper portion 31 in connection with the sole portion 32.

The connection between the sole portion 32 and the upper portion 31 will generally be sufficiently strong to prevent the sole portion 32 and the upper portion 31 from becoming disconnected during use. Typically, a user will be required to manually apply a force (for instance, by pulling, pushing, twisting or the like) the sole portion 32 and the upper portion 31 relative to one another in order to be able to disconnect the sole portion 32 and the upper portion 31. Such a situation is illustrated in FIG. 8.

Figure 8:
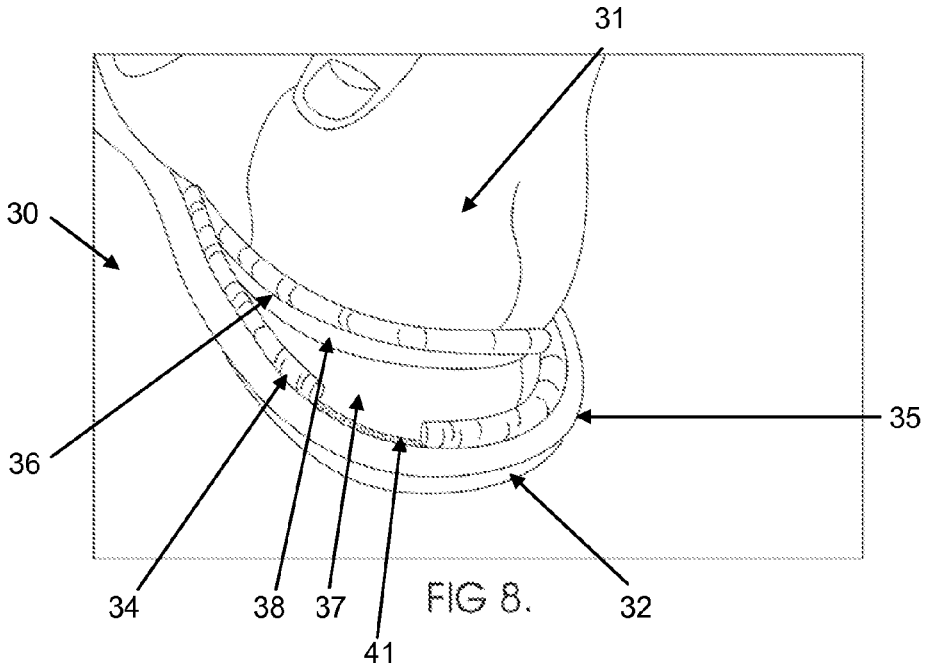
FIG. 8 illustrates a perspective view of a heel region of a footwear item according to an embodiment of the present invention.

In FIG. 8, the heel region of the footwear item 30 may be seen. In this Figure, a user has partially disconnected the upper portion 31 from the sole portion 32. It may be seen in this Figure that the sole portion 32 is provided with a connection member 34 extending partially along an outer periphery 35 of the sole portion 32. The connection member 34 is adapted to connect with the support element 36 such that the upper portion 31 is retained in connection with the sole portion 32 during use.

The connection member 34 extends only partway around the periphery of the sole portion 32, and a gap 41 is provided between opposed ends of the connection member 34. The gap 41 is provided so that a user can insert a finger or tool into the gap 41 to gain access to the upper portion 31 so as to make disconnecting the upper portion 31 from the sole portion 32 easier.

The sole portion 31 is further provided with a recess 37 such that the upper 38 located on a lower surface (obscured) of the support element 36 may be housed within the sole portion 31 when not in use.

Figure 9:
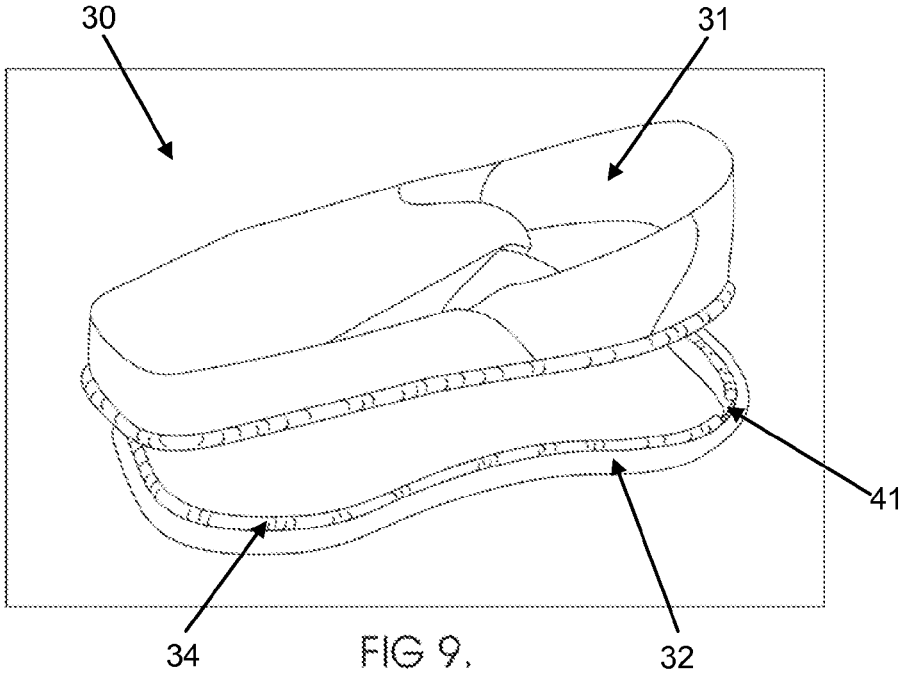
FIG. 9 illustrates a perspective view of a footwear item according to an embodiment of the present invention.

In FIG. 9, the footwear item 30 may be seen when the upper portion 31 is entirely disconnected from the sole portion 32. The gap 41 in the connection member 34 may be clearly seen in this Figure.

Figure 10:
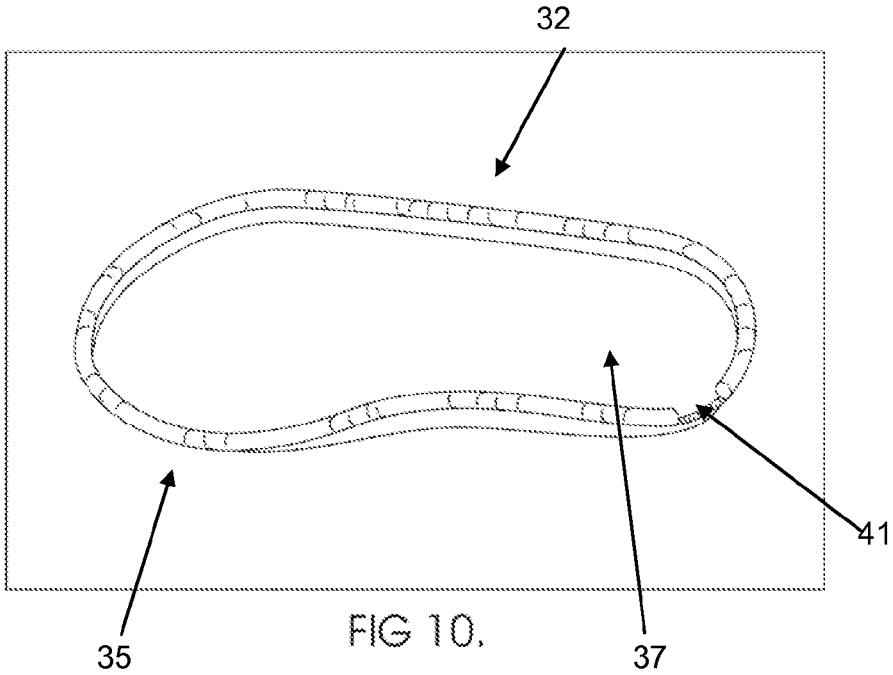
FIG. 10 illustrates a sole portion of a footwear item according to an embodiment of the present invention.

FIG. 10 illustrates a closer view of the sole portion 32 in which the recess 37 provided in the sole portion 31 for housing the non-active upper (not shown) may be clearly seen. In this embodiment of the invention the outer periphery 35 of the sole portion 31 is located at a different height to the recess 37.

Figure 11:
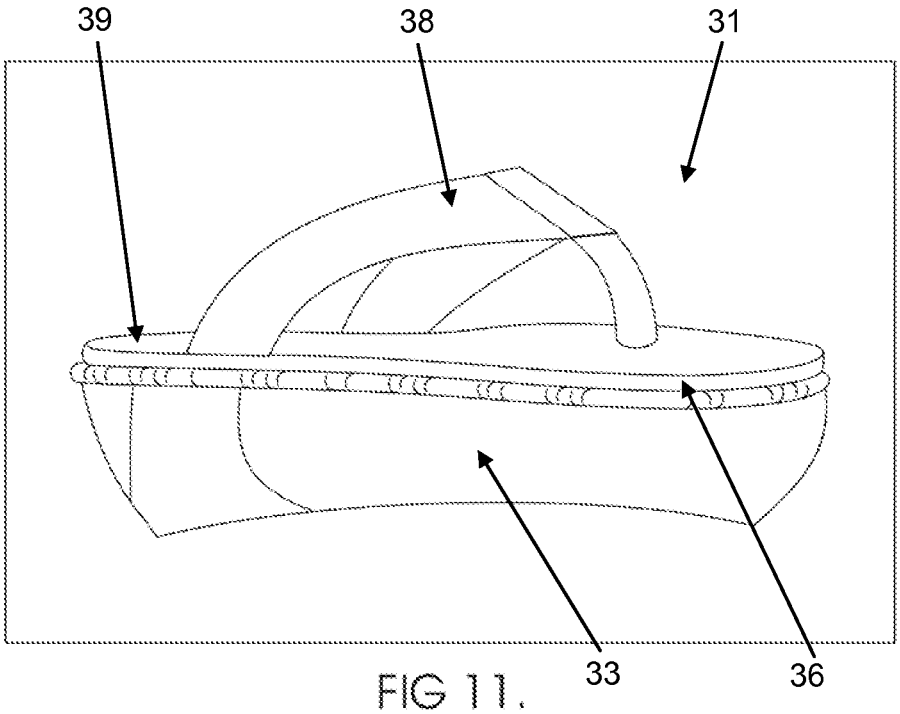
FIG. 11 illustrates an upper portion of a footwear item according to an embodiment of the present invention.

Turning now to FIG. 11, there is shown the upper portion 31 according to an embodiment of the present invention. In this Figure, the support element 36 may be clearly seen. A first surface 39 of the support element 36 is provided with an upper 38 in the form of a thong, while the second surface (obscured) is provided with an upper 33 in the style of a closed-in shoe. Thus, by removing the upper portion 31 from the sole portion (not shown) and reversing the orientation of the support element 36, the footwear item can be converted between different types of footwear.

Figure 12:
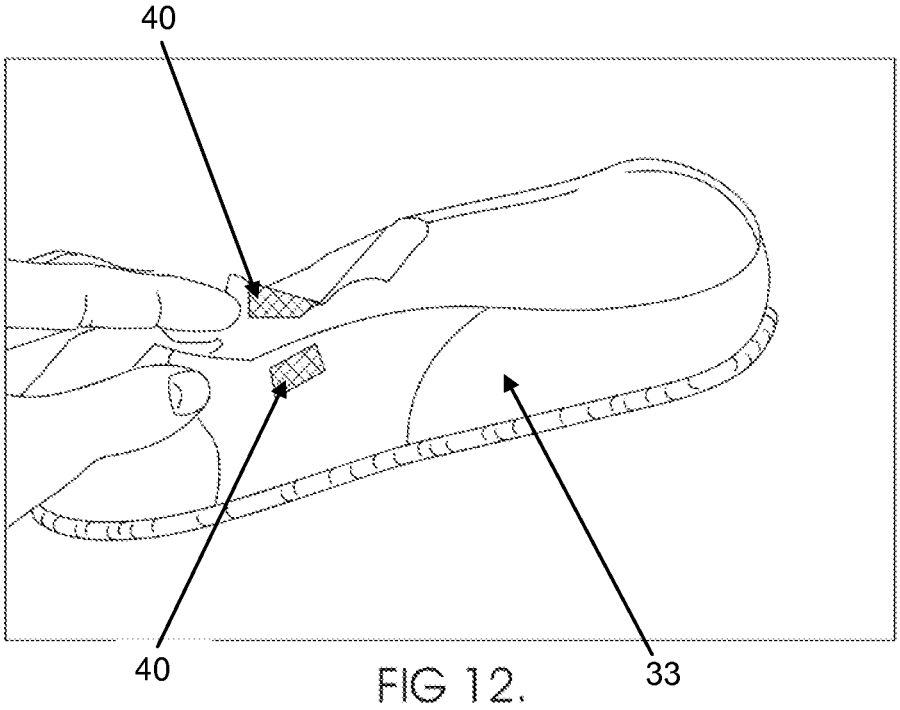
FIG. 12 illustrates an upper portion of a footwear item according to an embodiment of the present invention.

In FIG. 12, the upper 33 is shown being folded away in readiness for being housed within the recess (not shown) of the sole portion (not shown). It is important to ensure that the upper 33 is folded away neatly and flatly so that the user does not feel any lumps or bumps under their foot from the non-active upper. Thus, to assist the user in ensuring that the upper 33 is neatly folded away, the upper 33 is provided with Velcro patches 40 adapted to ensure that the upper 33 folds flat and does not move around when stored within the recess (not shown) of the sole portion (not shown).

Figure 13:
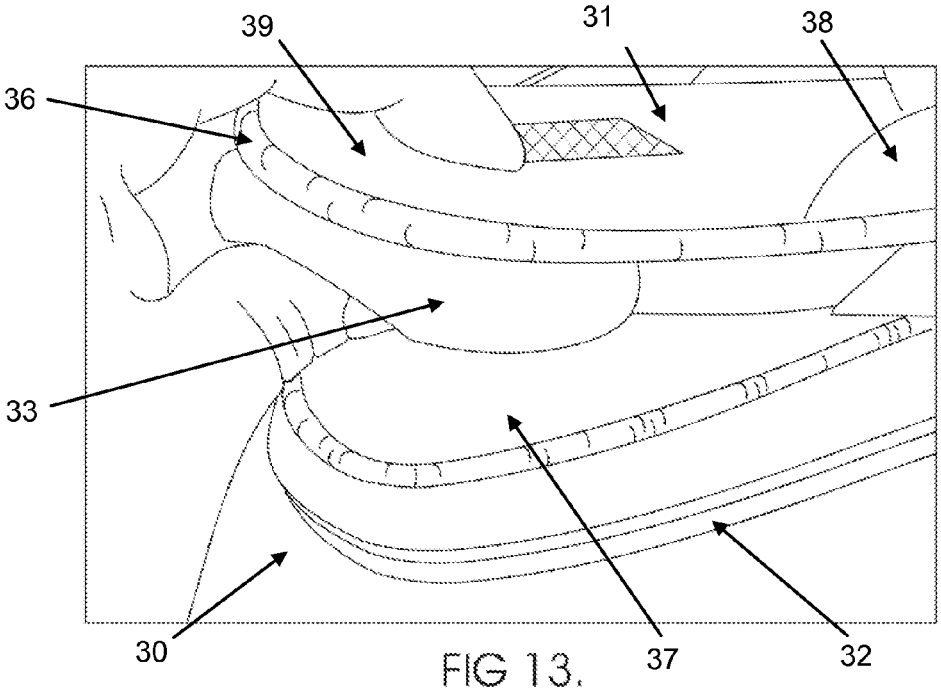
FIG. 13 illustrates a perspective view of a heel region of a footwear item according to an embodiment of the present invention.

FIG. 13 illustrates the footwear item 30 according to an embodiment of the present invention as the upper portion 31 is connected with the sole portion 32. In this Figure, the upper 33 in the style of a closed-in shoe has been folded away and the support element 36 is oriented such that the upper 33 is facing downwards for storage in the recess 37 of the sole portion 32.

In this Figure, the first surface 39 and the upper 38 in the form of a thong are now oriented facing upwards meaning that, once the upper portion 31 is fully connected with the sole portion 32, the footwear item 30 will be in the form of a thong.

Figure 14:
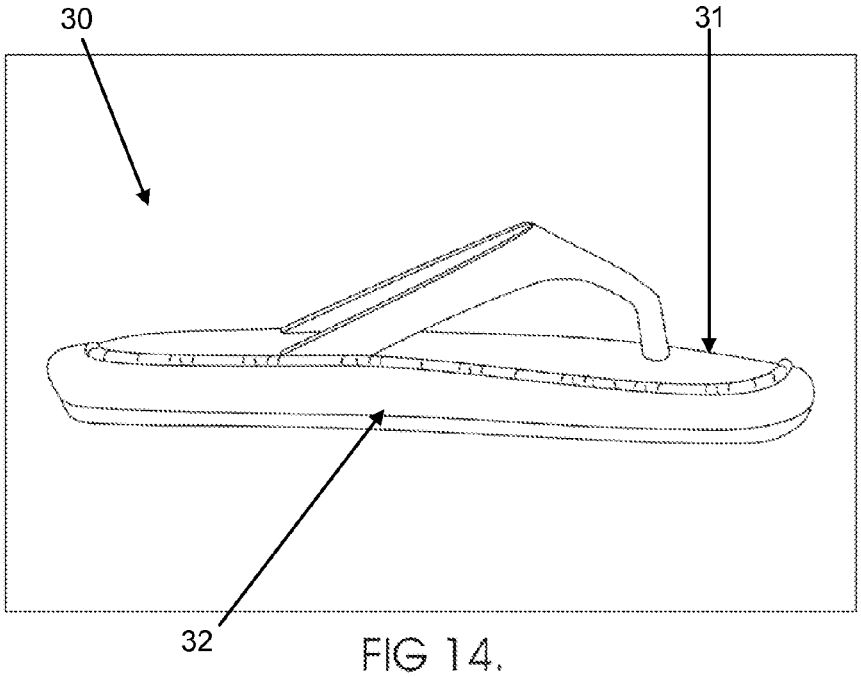
FIG. 14 illustrates a side view of a footwear item according to an embodiment of the present invention.

In FIG. 14, the footwear item 30 is shown with the upper portion 31 once again connected with the sole portion 32. In this Figure, the footwear item 30 is now in readiness to be worn by the user as a thong.

Figure 15A:
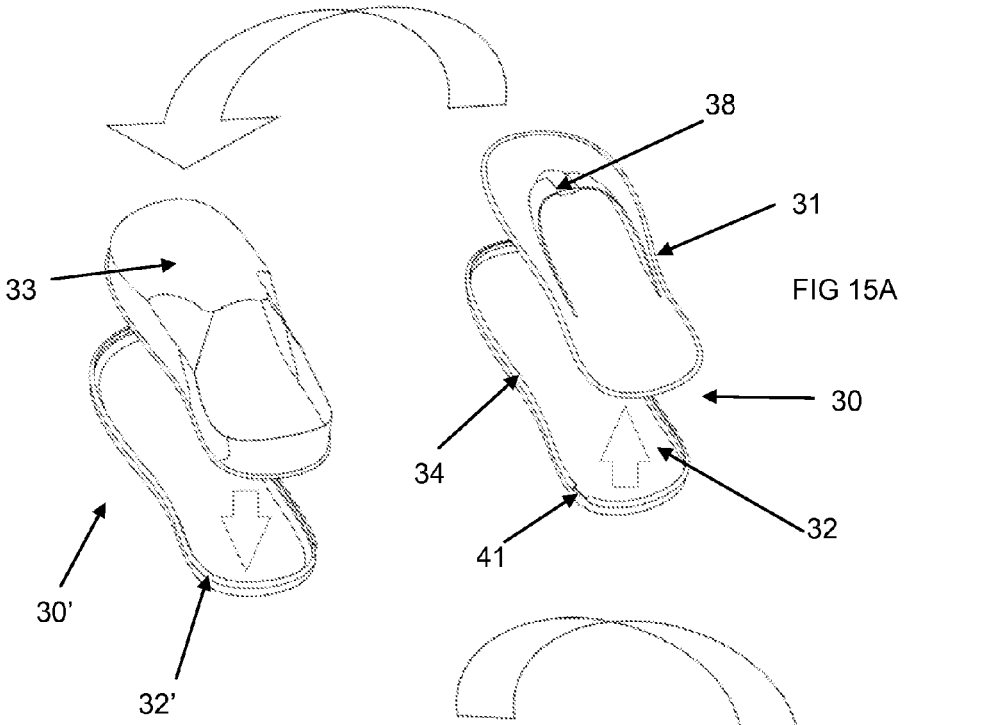
FIGS. 15A and 15B illustrates steps in the conversion of a pair of footwear items between different styles of footwear according to an embodiment of the present invention.
Figure 15B:
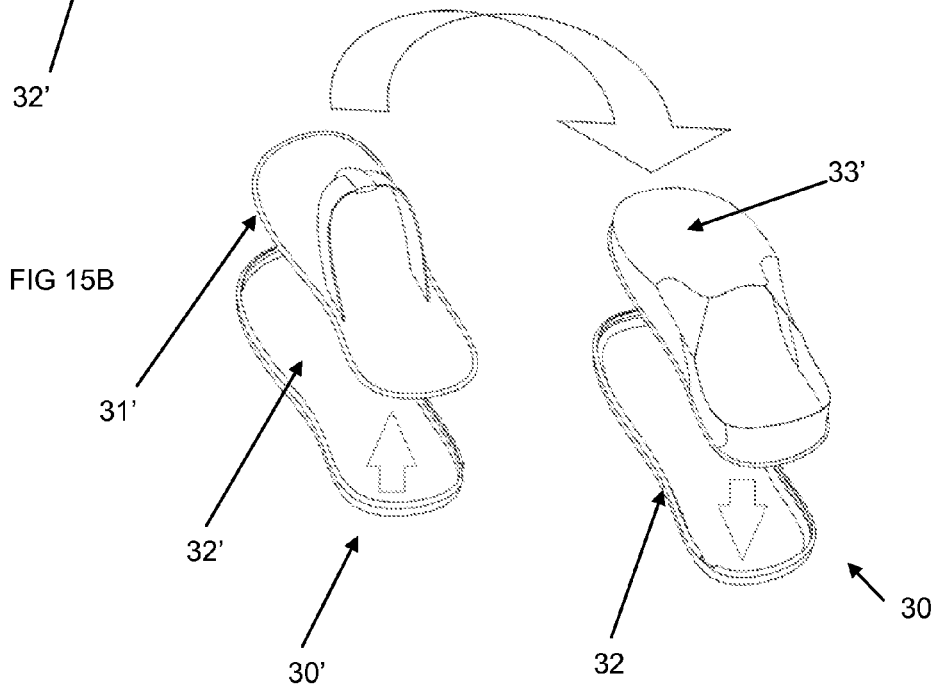

In FIGS. 15A and 15B there is illustrated steps in the conversion of a pair of footwear items 30, 30' between two different styles of footwear. In FIG. 15A, the upper portion 31 of the right footwear item 30 is connected to the sole portion 32 such that the upper 38 in the form of a thong is oriented facing upwards.

When it is desired to convert the pair of footwear items 30, 30' between styles of footwear, the upper portion 31 for a user's right foot is removed from the right foot sole portion 32 (by inserting a finger or tool into the gap 41 in the connection member 34). The upper portion 31 is then inverted so that the upper 33 in the form of a closed-in shoe is oriented facing upwards. Due to the fact that the upper portion 31 has been inverted so as to be a mirror image, the upper 33 is now suited for a user's left foot and, as a result, the upper portion 31 is then re-connected to the sole portion 32' adapted for a user's left foot.

Similarly, as shown in FIG. 15B, the upper portion 31' for the user's left foot is removed from the left foot sole portion 32' then inverted so that the upper 33' in the form of a closed-in shoe is oriented facing upwards. Due to the fact that the upper portion 31' has been inverted, the upper 33' is now suited for a user's right foot. The upper portion 31' is therefore re-connected to the right foot sole portion 32.

Figure 16:
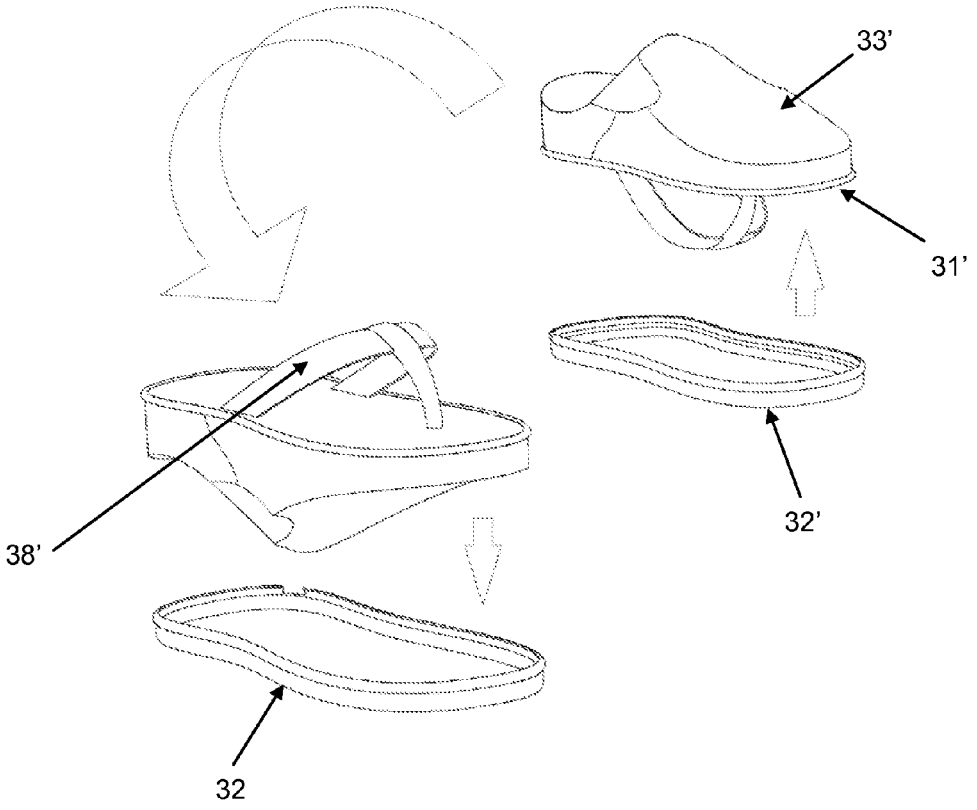
FIG. 16 illustrates a step in the conversion of a footwear item between different styles of footwear according to an embodiment of the present invention.

FIG. 16 illustrates a step in the conversion of a footwear item between two different styles of footwear. In this Figure, the left upper portion 31' (having an upper 33' in the form of a closed in shoe oriented upwards) is removed from the left sole portion 32' and is inverted so that the upper 38' in the form of a thong is oriented facing upwards. To complete the conversion the upper portion 31' is then re-connected to the right sole portion 32.

When the upper portion 31' is inverted between upper 33' and upper 38', the upper portion 31' becomes a mirror image. This means that an upper portion disconnected from a left sole portion and suitable for accommodating a user's left foot will, when inverted, need to be connected to a right sole portion as it is now suitable for accommodating a user's right foot.

It may be seen that the footwear item of the present invention provides a number of significant advantages over the prior art in that it allows the wearer to quickly and easily convert their footwear item from a casual style footwear item to a more formal style footwear item, and vice versa, depending on what is required for a given social situation or under particular weather conditions. By providing a footwear item that may easily convert between different styles of footwear, the same pair of footwear may be used in a wide variety of applications.

Those skilled in the art will appreciate that the present invention may be susceptible to variations and modifications other than those specifically described. It will be understood that the present invention encompasses all such variations and modifications that fall within its spirit and scope.

The invention claimed is:

1. A pair of footwear items including a left footwear item and a right footwear item, each of the footwear items comprising a sole portion, and an upper portion, the upper portion and the sole portion adapted for at least temporary connection to one another, the upper portion consisting of a support element having at least a first surface and a second surface and wherein each of the first surfaces includes an upper of a first style of footwear, and each of the second surfaces includes an upper of a second style of footwear, an upper surface of the sole portion being provided with one or more connection members adapted to connect to and retain at least a portion of the upper portion during use, the one or more connection members extending partway around the periphery of the sole portion so that one or more gaps in the connection members are provided around the periphery of the sole portion, and wherein the pair of footwear items is converted between the first and second styles of footwear by removing the upper portions from the left footwear item and the right footwear, inverting the upper portions, and connecting the upper portion removed from the left footwear item to the right footwear item and connecting the upper portion removed from the right footwear item to the left footwear item, and wherein when one surface of the support element is facing upwards, the upper of the other surface of the support element is housed within a recess in the sole portion.

2. The pair of footwear items according to claim 1 wherein the first surface and the second surface are located on opposite sides of the support element and are separated from one another by a thickness of the support element.

3. The pair of footwear items according to claim 1 wherein the one or more connection members comprise seals.

4. The pair of footwear items according to claim 1 wherein the upper portions are provided with one or more panels adapted to allow conversion of the upper portion between two or more styles of footwear.

5. The pair of footwear items according to claim 4 wherein the two or more styles of footwear are selected from the group consisting of a thong, slide, scuff, slipper, sandal or closed-in shoe.

6. The pair of footwear items according to claim 1 wherein the sole portions each comprise a lower surface and an upper surface, wherein the lower surface is adapted to be in contact with the ground when the footwear items are in use.

7. The pair of footwear items according to claim 6 wherein the lower surfaces of the sole portions are provided with one or more features selected from the group consisting of a flat heel, a high heel, a tread pattern, and/or one or more studs, cleats or spikes.

8. The pair of footwear items according to claim 1 wherein the upper portions are provided with retention elements for assisting in folding the upper portion prior to the upper portion being placed in the recess in the sole portion.

* * * * *